United States Patent [19]

Sunami et al.

[11] 4,132,419

[45] Jan. 2, 1979

[54] OIL SEAL RING FOR ROTARY PISTON ENGINES

[75] Inventors: Teruo Sunami; Tsuyoshi Morishita; Kazumi Hatakeyama, all of Hiroshima, Japan

[73] Assignee: Toyo Kogyo Co., Ltd., Aki, Japan

[21] Appl. No.: 799,980

[22] Filed: May 24, 1977

[30] Foreign Application Priority Data

May 31, 1976 [JP] Japan ..... 51-64291

[51] Int. Cl.[2] ..... F16J 15/34; C22C 29/00; C22C 37/00

[52] U.S. Cl. ..... 277/96.2; 75/123 R; 75/123 CB; 418/179; 428/682

[58] Field of Search ..... 418/179; 148/35; 75/123 R, 123 CB, 126 R, 126 A; 428/564, 682, 684, 685; 277/235 R, 81 P, 96.2; 271/236

[56] References Cited

U.S. PATENT DOCUMENTS

| | | | |
|---|---|---|---|
| 3,456,626 | 7/1969 | Jones | 123/8 |
| 3,849,078 | 11/1974 | Gobble et al. | 75/126 R |
| 3,877,854 | 4/1975 | Sasame et al. | 428/682 |
| 3,902,830 | 9/1975 | Maeda | 418/142 |
| 4,049,380 | 9/1977 | Yih et al. | 75/123 R |

*Primary Examiner*—Arthur J. Steiner
*Attorney, Agent, or Firm*—Fleit & Jacobson

[57] ABSTRACT

Oil seal ring comprising a base body and a lip formed thereon. The base body is made of a relatively flexible iron based material such as a cast iron. The lip is made of a mixture of iron-based alloy and one or more carbides by melting and thereafter solidifying the mixture on the body. Composite carbides are produced in the alloy and added carbides are distributed in the metal and the composite carbides in the alloy.

10 Claims, 4 Drawing Figures

(X1400)

(X200)

OIL SEAL RING FOR ROTARY PISTON ENGINES

Figure 1:
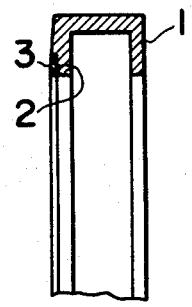

The present invention relates to rotary piston engines and more particularly to oil seal means therefor.

Conventional rotary piston engines include a casing comprising a rotor housing and a pair of side housings secured to the opposite sides of the rotor housing to define a rotor cavity therein. A rotor is disposed in the cavity for rotation about its own axis and revolution about the axis of an output shaft. In order to ensure that lubricant oil is prevented from entering working chambers which are defined between the casing and the peripheral surface of the rotor, oil seal means is provided on each of the side surfaces of the rotor.

For the purpose, conventional rotary piston engines have a circular or annular sealing groove on each of the side surfaces thereof for accommodating an oil seal ring. The oil seal ring has a lip and usually inserted into the sealing groove with a corrugated or bellows type spring behind the seal ring so that the lip on the seal ring is forced under the action of the spring into contact with the inner surface of the side housing. In this type of arrangement, it has been a common practice to provide such a lip by a wear resistant material. In the U.S. Pat. No. 3,456,626, for example, there is disclosed an oil seal ring having a lip formed of a chromium plated layer. However, since it has not been possible to obtain a satisfactory wear resistant property even by a use of such a chromium plated layer, the base of the seal ring has also been made of a wear-resistant cast iron containing high percentages of boron and phosphorus. Although such a seal ring has provided a certain improvement, adequate wear resistant property has not been achieved by the conventional technique and consequently rotary piston engines having such oil seal rings have been of relatively poor lubricant oil consumption.

The present invention has therefore an object to provide an oil seal ring for rotary piston engines, which has an improved wear resistant property.

Another object of the present invention is to provide an oil seal ring which is flexible enough to follow the contour of the co-operating surface of the side housing.

A further object of the present invention is to provide an oil seal ring which is flexible but has an adequate wear resistant property.

Still further object of the present invention is to provide an oil seal ring which has a base body made of resilient and tough material and a lip made of an alloy material having such composition and hardness that are not injurious to the co-operating surface.

A further object of the present invention is to provide an oil seal ring for rotary piston engines which has a sealing lip formed on a base body by melting and solidifying powders of alloy and carbides on the body.

According to the present invention, the above and other objects of the present invention can be accomplished by an oil seal ring for rotary piston engines which comprises a base body formed of an iron based material and sealing lip means formed on said base body by composite material which includes iron-based alloy containing in weight 3 to 6% of C,5 to 20% of Co, 1 to 6% of Mo and 1 to 8% of W and having 20 to 60%, by volume, of composite carbides of Mo, W and Fe produced therefrom, said composite material further including in weight 10 to 50% of at least one of $Mo_2C$, NbC, TaC and $Cr_3C_2$ dispersed therein. Most preferably, the lip means is formed from a mixture of powders of such iron-based alloy and powders of the aforementioned carbides by melting the mixture and solidfying it on the body of the seal.

It has been found that the oil seal ring in accordance with the present invention possesses a superior wear-resistant property and, besides, it is adequately flexible to follow the contour of the co-operating surface on the side housing but it is not injurious to the co-operating surface. As the results, the oil seal ring of the present invention provides significant improvements in the sealing property.

It has long been recognized that an oil seal ring for rotary piston engines must be flexible enough so that it is able to follow the co-operating surface on the side housing. In other words, such oil seal ring must be able to follow irregular or waved contour of the inner wall surface of the side housing during rotation of the rotor so that the lip portion thereon can keep contact with the wall surface. For the purpose, efforts have been made to improve the oil seals in respect of structure, dimensions and materials of the seals. However, it has been found that there are limitations in changing the structures and dimensions of the oil seal rings so that efforts of modifying these factors have not been successful.

Thus, the inventors have conceived to provide the base body of the seal ring with a flexible or resilient material having a low modulus of elasticity and to provide the lip portion by melting and thereafter solidifying powders or chips of wear resistant material on the body. According to the present invention, the material for the body shall have the modulus of elasticity not greater than $22 \times 10^3$ kg/mm$^2$. For example, use may be made of a normal steel having the modulus of elasticity of $21 \times 10^3$ kg/mm$^2$, a cast iron having the modulus of elasticity of $12 \times 10^3$ kg/mm$^2$ or an iron-based sintered alloy having the modulus of elasticity of $13 \times 10^3$ kg/mm$^2$.

The lip material as used in accordance with the present invention possesses a hardness in the range of 550 to 900 in Vickers scale. The produced or crystallized carbides in the iron-based alloy have needle shaped or elongated configurations which are 50 to 200 microns in length and 10 to 50 microns in width. The dispersed carbides, namely, $Mo_2C$, NbC, TaC and $Cr_3C_2$ are uniformly distributed in the composite material.

According to the present invention, the specific carbides having the specific hardness, sizes and distributions are effective to provide a satisfactory wear and seize resistant properties to the seal itself and further provide a property not injurious to the co-operating surface. Since the seal ring in accordance with the present invention is flexible as mentioned before, even a hard lip material may be used without providing a risk of damaging the co-operating surface. Consequently, the oil seal ring in accordance with the present invention can possess a longer life as compared with conventional seals.

Referring now to the iron-based alloy adopted in the lip material, the carbon content is essential in providing a wear resistant property. With the carbon content less than 3 percent in weight, adequate wear resistant property will not be obtained, but with the carbon content exceeding 6 percent in weight, there will be eduction of graphite resulting in a poor fluidity and a decreased wear resistant property. Thus, the carbon content shall be 3 to 6 percent in weight. More preferably, the carbon content should be 3.5 to 5 percent.

Cobalt is known as an element which forms a tough solid solution with iron. Further, it provides a strong binding between the base material and carbides. However, a satisfactory result will not be obtained with the Co content less than 5 percent in weight. With the Co content exceeding 20 percent in weight, there will be an excessive amount of metal so that the wear resistant property will be adversely affected. Thus, the Co content shall be 5 to 20 percent in weight and preferably 10 to 15 percent.

Molybdenum provides a compound with carbon and improves the wear resistant property, however, a satisfactory result cannot be obtained with the Mo content less than 1 percent in weight. With the Mo content exceeding 6 percent in weight, there will be an decrease in toughness and the seal may possibly be broken in machining process. Thus, the content shall be 1 to 6 percent in weight and preferably 2 to 5 percent.

Tungsten is also an element which provides an improvement in the wear resistant property as in molybdenum by producing carbides, however, an adequate effect cannot be obtained with the content less than 1 percent in weight. Further, with the content exceeding 8 percent in weight, there will be an adverse effect on the toughness. Thus, the W content shall be 1 to 8 percent in weight, preferably 2 to 6 percent.

The composite carbides of Mo, W and Fe are believed as being effective to improve the wear and seize resistant property. With the amount less than 20%, by volume, the effects will not be sufficient, but with the amount exceeding 60 percent in volume, the base material will become too brittle. Thus, the amount of the composite carbides shall be 20 to 60%, by volume. Preferably the amount should be 25 to 50 percent.

According to the present invention, it is also preferable to add less than 4 percent, preferably 1 to 3 percent in weight of phosphorus. Such addition of phosphorus is effective to lower the melting point of the material so that the melting process can be facilitated. Further, the phosphorus produces a steadite which is less injurious to the co-operating surface and provide a superior workability.

The iron-based alloy for the lip material may further contain less than 10 percent in weight of V or Cr without having any adverse effect.

The additional carbides $Mo_2C$, NbC, TaC and $Cr_3C_2$ have greater hardness than the carbides produced in the iron-based alloy so that they are most effective in improving the wear resistant property of the seal. The above listed carbides can be suitably used because they are affinitive to the aforementioned iron-based alloy. Although they have sufficient hardness, they are not so hard to damage the co-operating surface. With these carbides less than 10 percent in weight, an adequate improvement on the wear resistant property cannot be obtained. With the content of these carbides exceeding 50 percent in weight, however, the excessive carbides will make the material brittle and the material may possibly be broken in machining operation. Thus, the content of the carbides shall be 10 to 50 percent in weight and preferably 15 to 30 percent.

It is also preferably to maintain the total amount of the carbides produced in the iron-based alloy and the added carbides between 20 to 80%, by volume.

Figure 3:
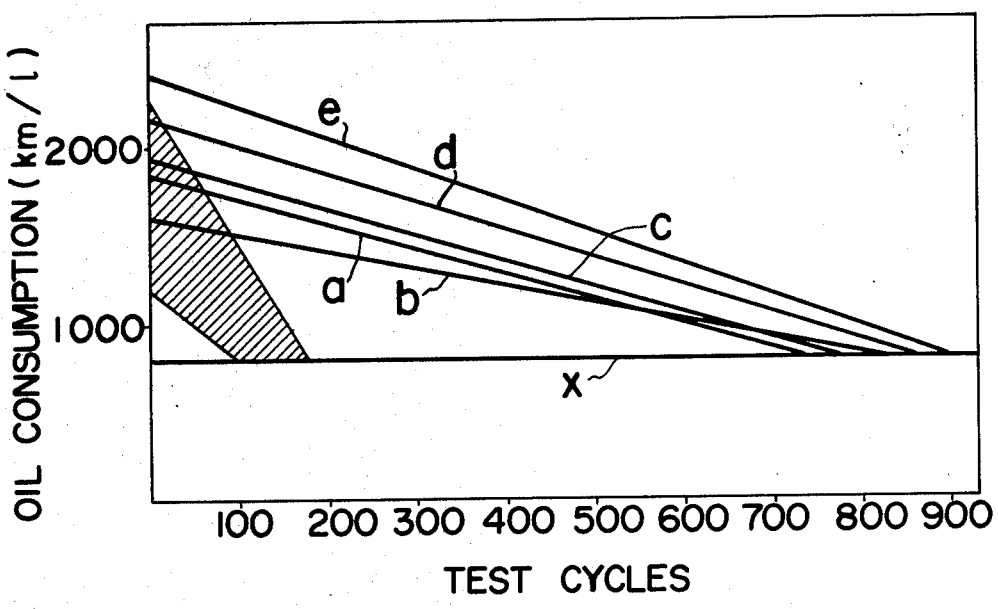
Figure 2A:
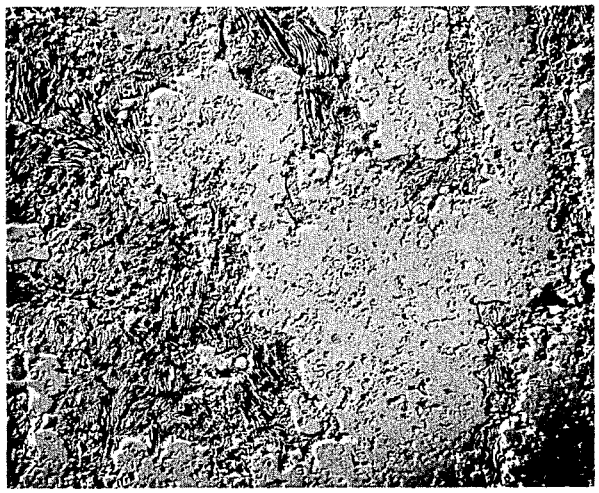
Figure 2B:
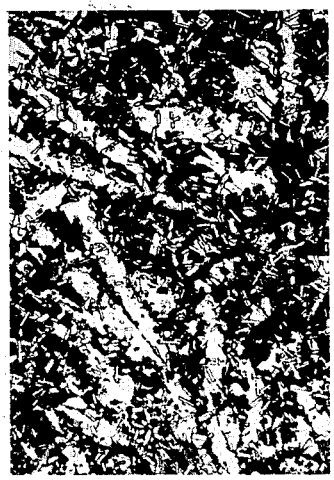

The present invention will now be described with reference to a preferable embodiment and examples taking reference to the accompanying drawings, in which:

FIG. 1 is a fragmentary sectional view of an oil seal ring in accordance with one embodiment of the present invention;

FIGS. 2(*a*) and (*b*) microscopic photographs of lip materials in accordance with the present invention; and FIG. 3 is a diagram showing test results using the oil seal rings in accordance with the present invention.

Referring to the drawings, particularly to FIG. 1, there is shown an oil seal ring comprising a body 1 made of a material referred to above. The body 1 is formed with a groove or cut-off 2 where a lip 3 is formed. As well known in the art, the lip 3 is brought into sliding contact with the inner wall surface of the side housing (not shown). The lip 3 is made of the aforementioned material by providing chips or particles of such material, depositing them in the groove 2 and heat them to melt. After the lip material is solidified, it is machined into a desired configuration. The present invention will further be described by way of examples.

EXAMPLE 1

A ring member was provided by S-45C steel material meeting JIS specification and having modulus of elasticity of $21 \times 10^3$ kg/mm$^2$. The ring had an outer diameter of 127 mm, an inner diameter of 117 mm and a height of 6 mm. The ring was formed at its top side with a groove of 3.5 mm wide and 1.0 mm deep. The groove was filled with a mixture of iron-based alloy and carbides both in the form of powder finer than 150 mesh in particle size.

The iron-based alloy contained in weight 3.0 percent of C, 5 percent of Co, 1.0 percent of Mo, 1.0 percent of W and the balance Fe. The powder of such iron-based alloy was added with 10 percent in weight of $Mo_2C$ as carbides.

The mixture was compacted as described in the copending patent application Ser. No. 780,970, filed on Mar. 24, 1977 which corresponds to Japanese patent application Sho 51-32845 filed on Mar. 24, 1976, and heated under a temperature of 1150 to 1160° C. in a non-oxydizing atmosphere for 15 minutes. Thus, the mixture was molten and solidified to form a lip portion on the ring member. The lip portion was then machined into the configuration as shown in FIG. 1. The resultant seal ring was 126 mm in outer diameter, 119 mm in inner diameter and 5.7 mm in height.

In the lip portion, the material contained compound carbides $(Fe.Mo.W)_mC_n$ by an amount of 20%, by volume. The total amount of carbides was 30%, by volume, and the material had an average hardness of 550 to 650 in Vickers scale.

The configuration shown in FIG. 1 is suitable for use as the outer oil seal ring of a rotary piston engine, however, it should be noted that inner oil seal rings may also be produced by employing a similar process. In this example, an inner seal was also provided and it was 116 mm in outer diameter, 109 mm in inner diameter and 5.6 mm in height.

EXAMPLE 2

The same material was used for the body of ring as in the Example 1. Further, the ring member had the same configuration and dimensions as in the Example 1.

The lip material included an iron-based alloy containing in weight 6.0 percent of C, 20 percent of Co, 6.0 percent of Mo, 8.0 percent of W, 4.0 percent of P and the balance of Fe. Further, 50 percent in weight of NbC was added as the carbide.

Powders of such lip material were deposited in the groove of the ring body and compacted as in the previous example. The compacted material was then molten and solidified. The lip portion thus formed contained about 60 percent, by volume, of composite carbides $(Fe.Mo.W)_mC_n$. The total amount of carbides was about 85 percent in volume. Further, the lip portion had a hardness of 800 to 900 in Vickers scale.

EXAMPLE 3

For the body of seal ring, the same material, configuration and dimensions were employed as in the Example 1.

The lip material included iron-based alloy containing in weight 3.5 percent of C, 10 percent of Co, 2.0 percent of Mo, 1.0 percent of P, 2.0 percent of W and the balance of Fe. The lip material further contained 15 percent in weight of TaC. The lip material was compacted and molten as in the previous examples. The lip portion thus formed contained about 26 percent in volume of composite carbides $(Fe.Mo.W)_mC_n$ and the total amount of carbides was about 40 percent in volume. The hardness of the lip portion was 640 to 700 in Vickers scale.

EXAMPLE 4

For the body of seal ring, the same material, configuration and dimensions were employed as in the previous examples.

The lip material included iron-based alloy containing in weight 5.0 percent of C, 15 percent of Co, 5.0 percent of Mo, 6.0 percent of W, 3.0 percent of P and the balance of Fe. The lip material was added with 30 percent in weight of NbC as the carbide. A lip was formed using the lip material in a way similar to those employed in the previous examples. The lip portion thus formed contained about 48 percent in volume of composite carbides $(Fe.Mo.W)_mC_n$ and the total amount of the carbides was about 78 percent in volume. The hardness of the lip portion was 750 to 830 in Vickers scale.

EXAMPLE 5

For the body of the seal ring, the same material, configuration and dimensions were employed as in the previous examples.

The lip material included iron-based alloy containing in weight 4.3 percent of C, 14 percent of Co, 3.4 percent of Mo, 4.5 percent of W, 4.5 percent of Cr, 2.6 percent of V, 2.0 percent of P and the balance of Fe. The lip material was added with 20 percent in weight of $Mo_2C$ as the carbide. A lip was formed using the lip material in a way similar to those employed in the previous examples. The lip portion thus formed contained about 40 percent in volume of composite carbides $(Fe.Mo.W.Cr.V)_mC_n$ and the total amount of the carbides was about 60 percent in volume. The hardness of the lip portion was 700 to 780 in Vickers scale.

FIG. 2(*a*) shows a microscopic photograph of the composition of the material in the lip portion in the Example 3 with magnification power of 1400. In the photograph, TaC can be seen as fine particles while the composite carbides appear as smooth areas. The stripe areas in the photograph are provided by metals. In this photograph, it will be seen that TaC is distributed both in the composite carbides and metals.

FIG. 2(*b*) shows a microscopic photograph of the composition of the material in the lip portion in the Example 5 with magnification power of 200. In the photograph, the white needle like parts are presented by the composite carbides, the gray areas by $Mo_2C$, and the dark areas by metals. It will be noted in this picture that $Mo_2C$ is distributed in both the composite carbides and the metal.

The outer and inner oil seal rings thus prepared were assembled in rotary piston engines having two rotors and cast iron side housings, of which displacement for a single working chamber was 654 cc. The engines was subjected to repeated cycles of tests, each cycle comprising maintaining the engine stationary for two hours, operating it under an idling condition for two hours, subjecting it to rapid acceleration and deceleration between 1500 rpm and 3000 rpm for two hours and then operating it at 1500 rpm for three hours. During the tests, oil consumptions were periodically measured.

FIG. 3 shows the results of the tests. In this figure, the shadow area shows the oil consumption obtained in conventional rotary piston engines including oil seal rings each comprising a body of cast iron containing high percentages of boron and phosphorus and a chromium plating which provides a lip on the body. The lines a, b, c, d and e show the oil consumption as obtained in the engines using the oil seal rings prepared in accordance with the Examples 1, 2, 3, 4 and 5, respectively. The line x shows the allowable limit for the oil consumption.

In FIG. 3, it will be noted that the oil seal rings in accordance with the present invention have significantly improved durability. It is understood that such improvements have resulted from the novel combination of the relatively resilient base material and the wear resistant lip material.

The invention has thus been shown and described with reference to specific examples, however, it should be noted that the invention is in no way limited only to such examples but limitations are presented by the appended claims.

We claim:

1. Oil seal ring for rotary piston engines which comprises a base body formed of an iron based material and sealing lip means for forming a sealing lip on said base body from composite material which includes an iron-based alloy consisting essentially of in weight 3 to 6% of C, 5 to 20% of Co, 1 to 6% of Mo, 1 to 8% of W, and the remainder Fe and having 20 to 60% in volume of composite carbides of Mo, W and Fe produced therefrom, said composite material further including in weight 10 to 50% of at least one of $Mo_2C$, NbC, TaC and $Cr_3C_2$ dispersed therein.

2. Oil seal ring in accordance with claim 1 in which said iron-based alloy further contains less than 4 percent in weight of P.

3. Oil seal ring in accordance with claim 1 in which said iron-based alloy further contains less than 10 percent in weight of at least one of V and Cr.

4. Oil seal ring in accordance with claim 1 in which the total amount of carbides in the sealing lip means is between 20 and 80 percent in volume.

5. Oil seal ring in accordance with claim 1 in which said base body is made of a material having modulus of elasticity less than $22 \times 10^3$ kg/mm$^2$.

6. Oil seal ring for rotary piston engines which comprises a base body formed of an iron based material and sealing lip means for forming a sealing lip on said base body from composite material which includes an iron-based alloy consisting essentially of in weight 3.5 to 5% of C, 10 to 15% of Co, 2 to 5% of Mo, 2 to 6% of W, and the remainder Fe and having 25 to 50% by volume of composite carbides of Mo, W and Fe produced therefrom, said composite material further including in weight 15 to 30% of at least one of $Mo_2C$, NbC, Tac and $Cr_3C_2$ dispersed therein.

7. Oil seal ring in accordance with claim 6 in which said iron-based alloy further contains less than 4 percent in weight of P.

8. Oil seal ring in accordance with claim 6 in which said iron-based alloy further contains less than 10 percent in weight of at least one of V and Cr.

9. Oil seal ring in accordance with claim 6 in which the total amount of carbides in the sealing lip means is between 20 and 80 percent in volume.

10. Oil seal ring in accordance with claim 6 in which said base body is made of a material having modulus of elasticity less than $22 \times 10^3$ kg/mm$^2$.

* * * * *